US007789258B1

(12) United States Patent
Anderson

(10) Patent No.: US 7,789,258 B1
(45) Date of Patent: Sep. 7, 2010

(54) MOBILE SELF-CONTAINED NETWORKED CHECKPOINT

(75) Inventor: Steven E. Anderson, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 770 days.

(21) Appl. No.: 11/801,769

(22) Filed: May 7, 2007

(51) Int. Cl.
*B65D 6/00* (2006.01)

(52) U.S. Cl. ..... 220/6; 220/1.5; 220/666; 89/36.07

(58) Field of Classification Search ..... 220/1.5, 220/6, 666; 89/36.04, 36.07; 86/50
See application file for complete search history.

(56) References Cited

U.S. PATENT DOCUMENTS

| | | | | |
|---|---|---|---|---|
| 4,248,342 | A * | 2/1981 | King et al. | 206/3 |
| 4,574,523 | A * | 3/1986 | Nasatka | 49/49 |
| 4,577,772 | A * | 3/1986 | Bigliardi | 220/1.5 |
| 4,630,395 | A * | 12/1986 | Nasatka | 49/49 |
| 5,274,356 | A * | 12/1993 | Taricco | 340/515 |
| 5,613,453 | A * | 3/1997 | Donovan | 110/237 |
| 6,112,931 | A * | 9/2000 | Booth et al. | 220/88.1 |
| 6,341,708 | B1 * | 1/2002 | Palley et al. | 220/1.5 |
| 6,354,181 | B1 * | 3/2002 | Donovan | 86/50 |
| 6,587,790 | B1 * | 7/2003 | Arnold | 701/213 |
| 6,862,847 | B2 * | 3/2005 | Bigelow | 52/79.1 |
| 7,102,512 | B2 | 9/2006 | Pendergraft | 340/540 |
| 7,106,192 | B2 | 9/2006 | Johnson et al. | 340/540 |
| 7,159,503 | B1 * | 1/2007 | Weatherwax | 89/36.04 |
| 7,374,056 | B2 * | 5/2008 | Linares | 220/1.5 |
| 7,536,170 | B2 * | 5/2009 | Goldman et al. | 455/404.1 |
| 2007/0012168 | A1 * | 1/2007 | Weatherwax | 89/36.04 |
| 2007/0234892 | A1 * | 10/2007 | Goldman et al. | 89/1.13 |
| 2008/0134868 | A1 * | 6/2008 | Goldman et al. | 89/1.13 |

(Continued)

*Primary Examiner*—Michael Carone
*Assistant Examiner*—Michael D David
(74) *Attorney, Agent, or Firm*—Oscar A. Towler, III Esq; Gerhard W. Thielman, Esq

(57) ABSTRACT

A portable checkpoint system is disclosed that incorporates a configurable freight container to facilitate transport and conversion for operation. The container is disposable into closed and open configurations. The closed configuration enables the container to be transported. The open configuration enables a vehicle to drive therethrough. In the closed configuration, the container forms a quadrilateral set of walls connectable in a rectangular box. A hinge joins two adjacent walls along a pivotable edge and pivots between perpendicular and coplanar positions corresponding respectively to the closed and open configurations. A joint reversibly connects two walls opposite the adjacent walls along a separable edge, disconnecting from a lock position to an unlock position that correspond respectively to the closed and open configurations. The hinge's perpendicular position disposes the two adjacent walls to be mutually perpendicular at the pivotable edge and forms the rectangular box. The hinge's coplanar position disposes the two adjacent walls to form substantially coplanar platforms to each other on which the vehicle can drive. The joint's latch position disposes the two opposite walls to be mutually perpendicular at the separable edge. The joint's unlock position disposes the opposite walls to form substantially parallel barriers to each other that define an inspection zone. The barriers and platforms include sensors for measuring characteristics of the vehicle. The checkpoint includes a communications system accessible to a database having information on vehicle identification, vehicle sensory characteristics, personal identification and facial-recognition photographs for comparison with the vehicle and its occupants.

14 Claims, 8 Drawing Sheets

U.S. PATENT DOCUMENTS

2008/0134869 A1* 6/2008 Goldman et al. ..... 89/1.13
2008/0134871 A1* 6/2008 Goldman et al. ..... 89/1.13
2008/0134872 A1* 6/2008 Goldman et al. ..... 89/1.13
2008/0266165 A1* 10/2008 Daly et al. ..... 342/22
2009/0090709 A1* 4/2009 Shalomoff ..... 220/6
2010/0025397 A1* 2/2010 Krohn ..... 220/6
2010/0043629 A1* 2/2010 Carberry et al. ..... 89/36.02
2010/0102056 A1* 4/2010 Bellehumeur et al. ..... 220/6

* cited by examiner

MOBILE SELF-CONTAINED NETWORKED CHECKPOINT

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a portable system for establishing a temporary roadway checkpoint for investigating entry and egress therethrough, with communication linkage to verification databases. More particularly, the invention relates to a system of sensor-equipped portals through which a vehicle passes while being inspected, each portal being foldable into a shipping container configuration.

The frequency of terrorist incidents that employ an improvised explosive device (IED) has increased dramatically since 1998, according to the Memorial Institute for the Prevention of Terrorism at http://www.tkb.org/Home.jsp. Mitigating this threat to life and property necessitates improved inspection of road-mobile vehicles that harbor such IEDs, as well as their occupants who clandestinely deploy them.

Unscheduled investigation of a vehicle traveling along a road typically necessitates tradeoffs that exacerbate the ability to intercept and mitigate against nefarious activities injurious to civil society, e.g., transport of contraband, deployment of improvised explosive devices, escape of individuals sought for custody, etc.

A roadblock checkpoint may entail risk to personnel for investigating a detained vehicle. Such an impromptu arrangement may locally lack information resources to identify any occupants or verify the vehicle's status. Moreover, the time devoted to such investigation may be curtailed to mitigate traffic impedance, resulting in reduced interception of intended targets. Static checkpoints for fixed installations with a more complete range of investigative tools may not be suitable for evasive targets.

Currently, modular checkpoints have been established to provide stations for screening individual persons seeking to enter a controlled area, such as an airport terminal. Such art includes U.S. Pat. Nos. 7,106,192 to Johnson et al. and 7,102,512 to Pendergraft.

SUMMARY

Conventional checkpoint arrangements yield disadvantages addressed by various exemplary embodiments of the present invention. In particular, the conventional systems lack a convenient ability to provide comprehensive sensory information on a vehicle at relocatable positions.

Various exemplary embodiments provide a portable checkpoint system that incorporates a configurable freight container to facilitate transport and conversion for operation. The container is disposable into closed and open configurations. The closed configuration enables the container to be transported. The open configuration enables a vehicle to drive therethrough. In the closed configuration, the container forms a quadrilateral set of walls connectable in a rectangular box.

A hinge joins two adjacent walls along a pivotable edge and pivots between perpendicular and coplanar positions corresponding respectively to the closed and open configurations.

A joint reversibly connects two walls opposite the adjacent walls along a separable edge, disconnecting from a lock position to an unlock position that correspond respectively to the closed and open configurations.

The hinge's perpendicular position disposes the two adjacent walls to be mutually perpendicular at the pivotable edge and forms the rectangular box. The hinge's coplanar position disposes the two adjacent walls to form substantially coplanar platforms to each other on which the vehicle can drive. The joint's latch position disposes the two opposite walls to be mutually perpendicular at the separable edge. The joint's unlock position disposes the opposite walls to form substantially parallel barriers to each other that define an inspection zone.

In various embodiments, the barriers and platforms include sensors for measuring characteristics of the vehicle. Other embodiments provide a communications system for the checkpoint, being accessible to a database having information on vehicle identification, vehicle sensory characteristics, personal identification and facial-recognition photographs for comparison with the vehicle and its occupants.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention.

Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The portable system to provide vehicle checkpoints, for various exemplary embodiments, employs at least one freight container. The system preferably uses the 40-ft (12.2 m) version for cargo shipping as well as rail transport; also known as the "forty-foot equivalent unit" (FEU). The 40-ft container has interior dimensions of length 39 ft ⅜ in, width 7 ft 8⅜ in, and height 7 ft 9⅝ in for a total volume of 2,376 $ft^3$.

An alternative is the 20-ft (6 m) version, also known as the "twenty-foot equivalent unit" (TEU). Thus, an FEU is equivalent to two TEUs. Other standard lengths include 45-ft (13.7 m), 48-ft (14.6 m) and 53-ft (16.2 m). These freight containers comply with ISO (International Standards Organization) requirements. The maximum gross mass for a 20-ft dry cargo container is 24,000 kg, and for a 40-ft is 30,480 kg yielding respective payload masses (gross minus tare) of about 21,600 kg and 26,500 kg.

Figure 1:
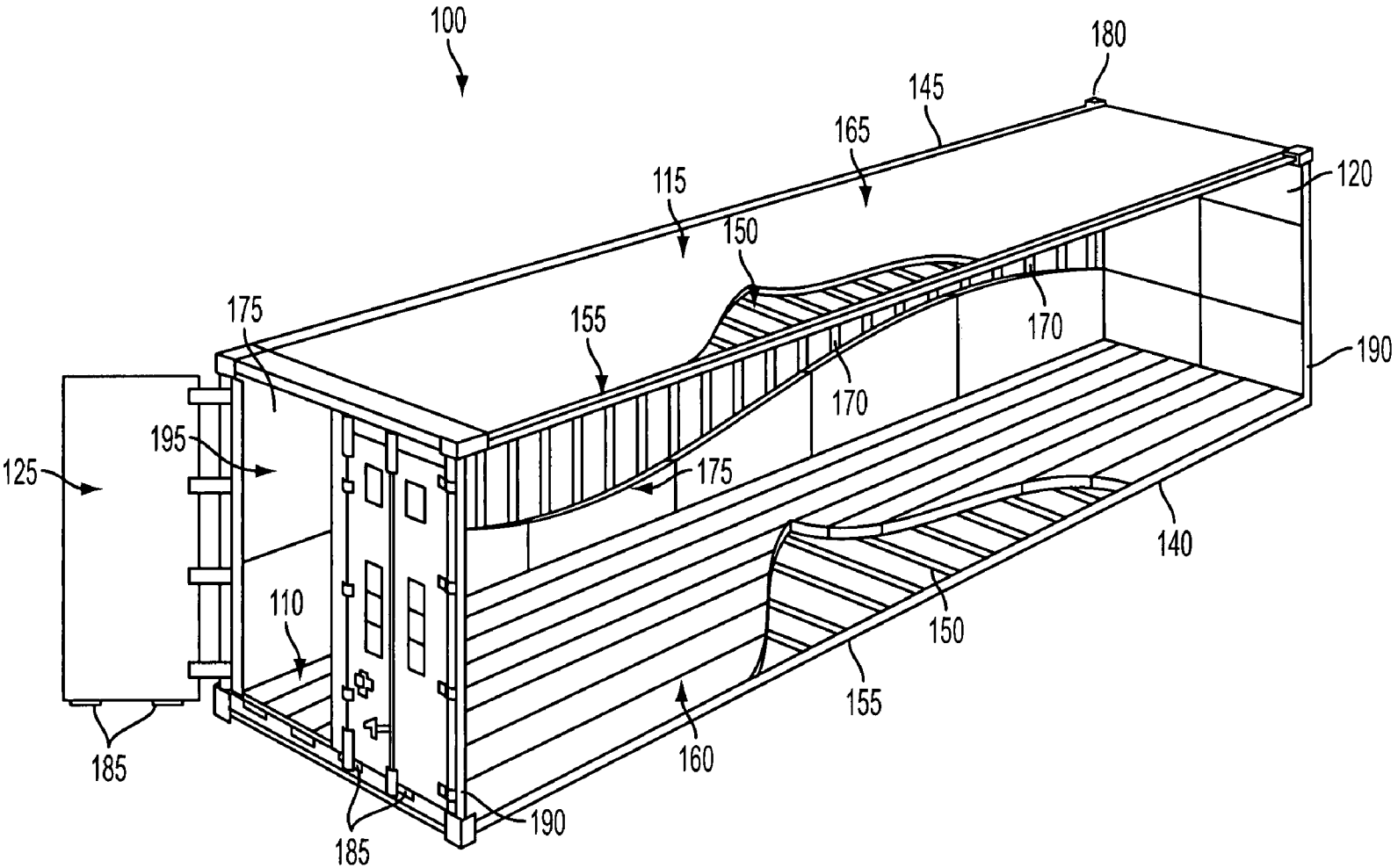
FIG. 1 is a perspective view of a modified freight container in stowed configuration.

FIG. 1 shows an isometric view of an exemplified embodiment of an FEU freight container 100 in folded and stowed configuration for transportability. Upon delivery to an installation site, the container 100 may be disposed with a bottom floor 110 on the ground opposite a top ceiling 115.

The container 100 includes front and rear ends, with the front end 120 being closed or alternatively having doors, and the aft end having doors 125 may be opened and secured to their respective left and right side walls 130, 135. (The front and rear ends merely represent an orientation convention, which is not intended to be limiting.) Alternatively, the doors 125 may be removed and installed as ramps for vehicle approach and departure. The floor 110, left wall 130, ceiling 115 and right wall 135 may be connected along their edges to form an open rectangular box, which can be closed by securing the doors 125.

A longitudinal hinge 140 (shown along the lower starboard edge) enables the container 100 to separate at an opposite lockable joint 145 (shown along the upper port edge). The right side wall 135 may swing down to the ground, substantially parallel to the bottom floor 110, while the top ceiling 115 forms a deployed starboard barrier. The left side wall 130 forms the deployed port barrier, substantially parallel to the ceiling 115 as deployed.

Thus, the hinge 140 rotatably connects two joined adjacent walls of the container 100 along a first common edge, and the joint 145 connects the opposite adjacent walls along a second common edge opposite the first. The hinge 140 at the first common edge may swing from an orthogonal closed position to a coplanar open position. Similarly, the joint 145 at the second common edge may remain integral at the closed position and separated at the open position.

The closed position maintains the two joined adjacent walls mutually perpendicular to each other and the opposite walls together, also mutually perpendicular. The open position disposes the joined adjacent walls to be parallel and alongside each other, as well as the opposite walls to be separate and facing each other from opposing ends of the coplanar walls.

Cutaway portions illustrate interior structures of the floor 110, ceiling 115, left side wall 130 and right side wall 135. The floor 110 and ceiling 115 include cross-members 150 extending from edge rails 155 (e.g., including the hinge 140) and sandwiched between interior boards 160 and exterior panels 165.

The side walls 130, 135 include posts 170 disposed outside of interior panels 175 as corrugation structural support. The corners 180 between the headers may be reinforced for increased structural integrity. The doors 120, 125 may be locked by locking bars or latches 185 and hinged to support frames 190. The boundaries of the container 100 enclose a cargo space 195 having a standard volume defined based on length and height.

Figure 2B:
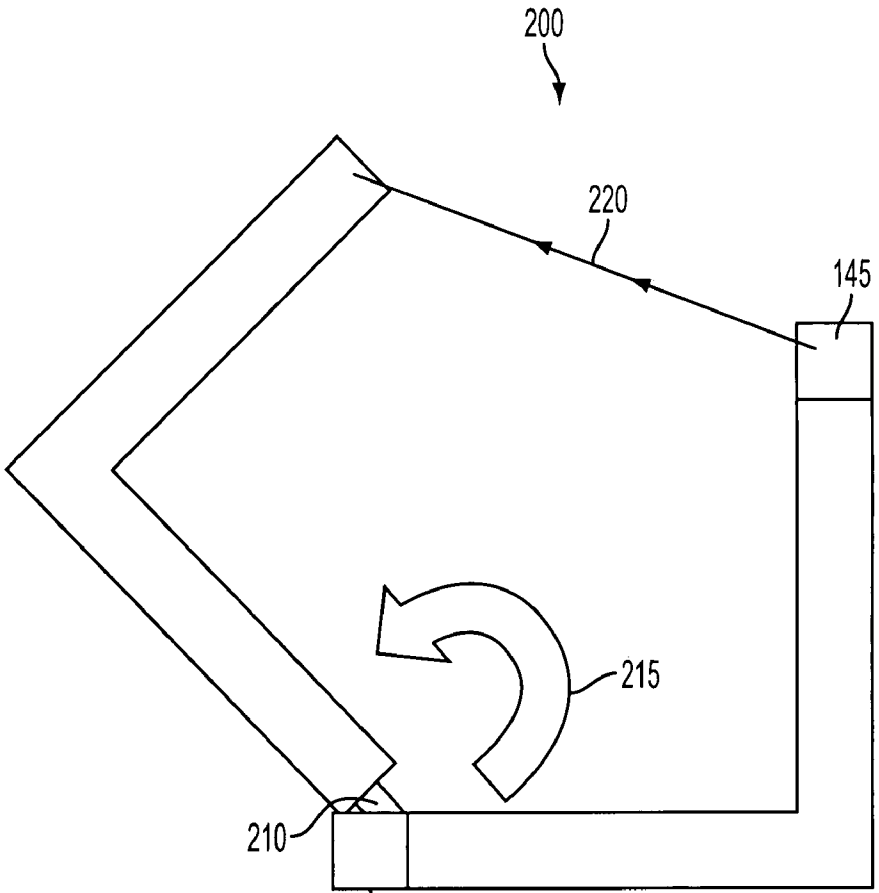
FIGS. 2A and 2B are elevation views of the container in stowed and deploying configurations, respectively.
Figure 2A:
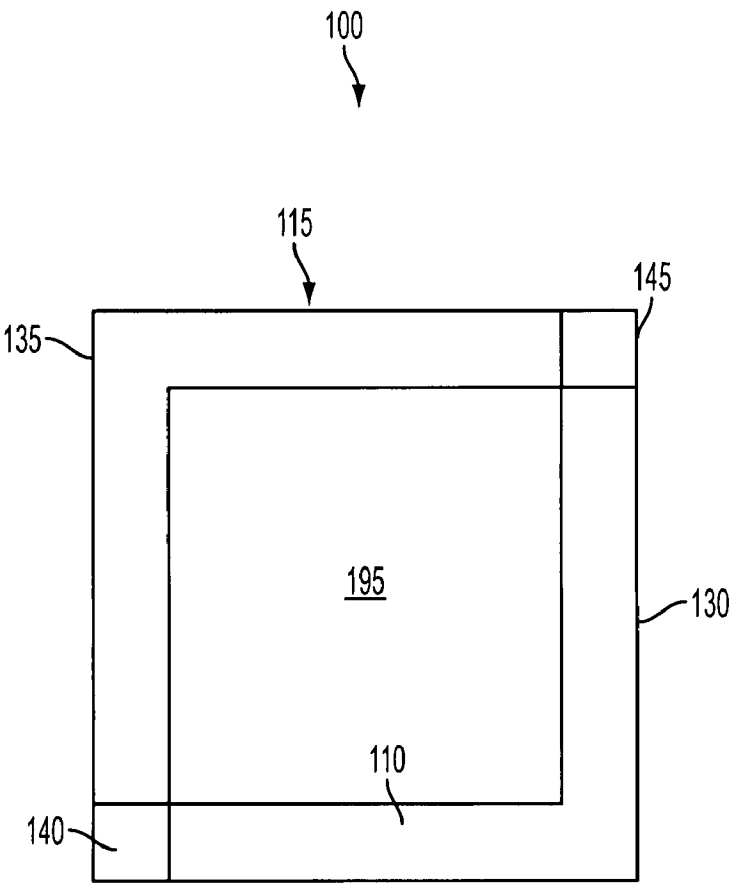

FIGS. 2A and 2B illustrate elevation views of the container as observed from the forward (front) end looking towards the aft (rear) end. FIG. 2A shows the container 100 as stowed with the joint 145 closed and locked. FIG. 2B shows, in deployment configuration, the container as a channel 200 unfolding with the hinge 140 extending and pivoting to rotate the right side wall 135 toward the ground.

The hinge 140 may include an hydraulic actuator 210 to enable the right wall 135 to pivot relative to the floor 110 without interference. The rotation is shown in the direction of the angling arrow 215. As the joint 145 unlocks, cables 220 may extend between a left edge on the left side wall 130 and a right edge on the ceiling 115 to facilitate control during deployment, thereby avoiding sudden descent of the right side wall 135 with possible risk of injury for crew.

Figure 3:
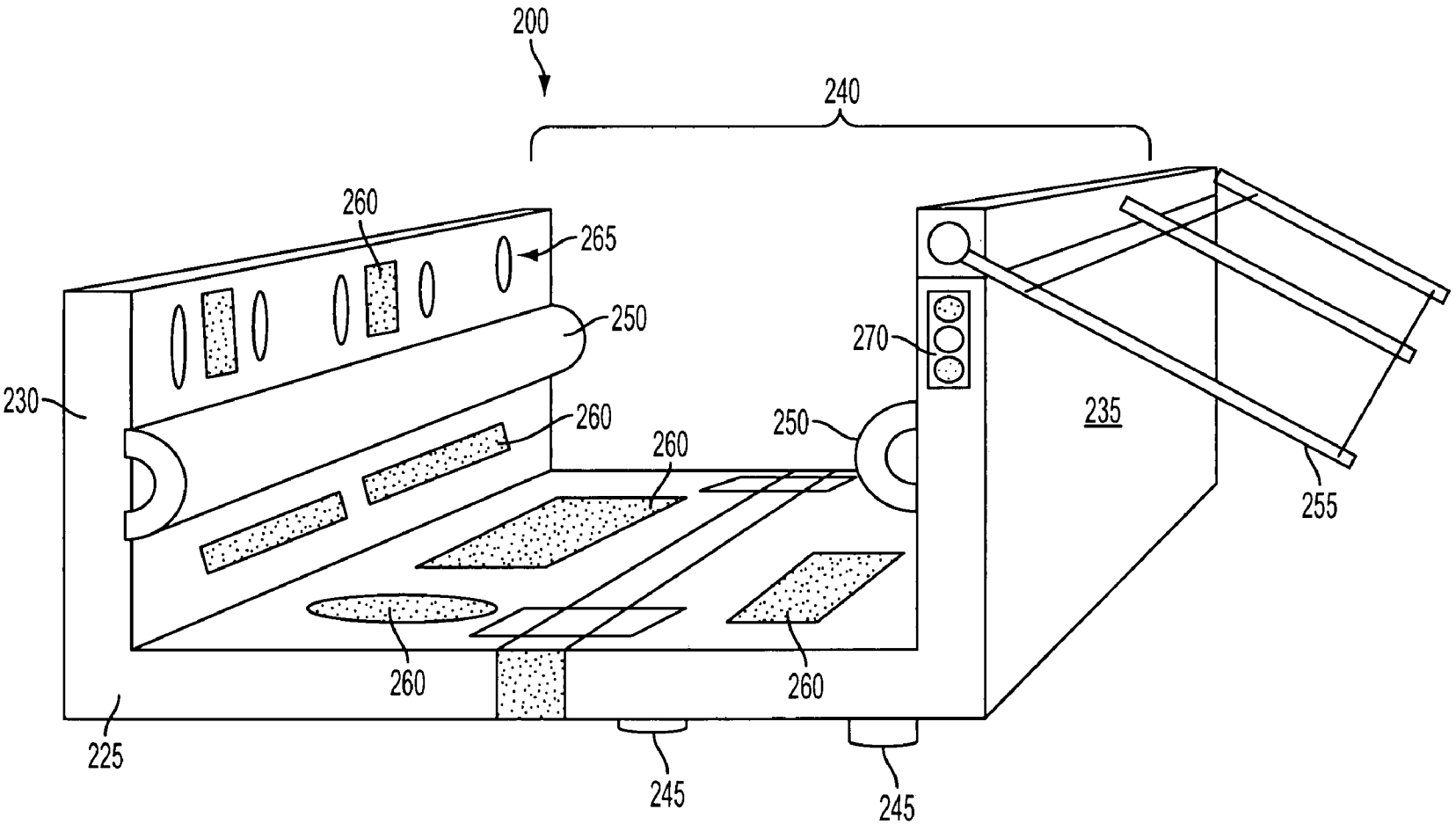
FIG. 3 is a perspective view of the container in deployed configuration as a channel.

FIG. 3 shows an isometric view of the deployed channel 200 as observed from the aft end looking toward the forward end. The floor 110 and the right side wall 135, parallel and in tandem, form the deployed drive platform 225. Thus, the left side wall 130 in the stowed configuration represents the deployed port barrier 230, whereas the ceiling 115 forms the deployed starboard barrier 235. The substantially parallel barriers 230, 235 define an inspection or surveillance zone 240 in which a vehicle therethrough can be investigated and/or detained as a further security procedure.

The underside of the drive platform 225 (from either the floor 110 and/or the right side wall 135) may include conformable pads 245 that extend from the outer surfaces thereby enabling the channel 200 to be disposed level to the ground. These pads 245 may be independently or automatically controlled to provide self-leveling capability. Otherwise, local variations in ground topology, such as obstructions or cavities from natural or artificial causes may produce unevenly distributed loading. Such conditions could adversely influence instrumentation and/or buckle the deployed channel 200, thereby inhibiting stowage reconfiguration.

Deformably elastic rails or bumpers 250 may protrude into the zone 240 to inhibit a vehicle from inadvertent contact with the barriers 230, 235. The bumpers 250 may be intermittently distributed over portions of the barriers 230, 235 or alternatively extend over their entire lengths. Lightweight anti-personnel barriers 255 may pivotably overhang from the tops of the barriers 230, 235 to inhibit unauthorized intruders from invading the zone 240.

A variety of embedded sensors 260 and recessed light sources 265 may be disposed along the interior surfaces of the drive platform 225 and the barriers 230, 235. These sensors 260 may include instruments to measure or detect, for example, chemical and/or physical responses to particular contraband, such as conventional explosives, narcotics, materials for such synthesis, etc.

Additionally or alternatively, the sensors 260 may include videographic instruments to distinguish and/or record optical and audio signatures of the transiting vehicle's exterior and interior features. Photometric sensors for optical measurements may, for example, be sensitive to the ultraviolet, visible, infrared, microwave and/or radio electromagnetic spectrums. The light sources 265 may provide illumination for the zone 240, particularly for nighttime operations.

A traffic signal 270 may be disposed at or adjacent to one or both of the barriers 230, 235. The traffic signal 270 may be positioned at the aft end of the channel 200, as shown for approach instruction, and/or towards the forward end (for departure instruction) to control entrance and egress of vehicles for inspection.

Figure 4A:
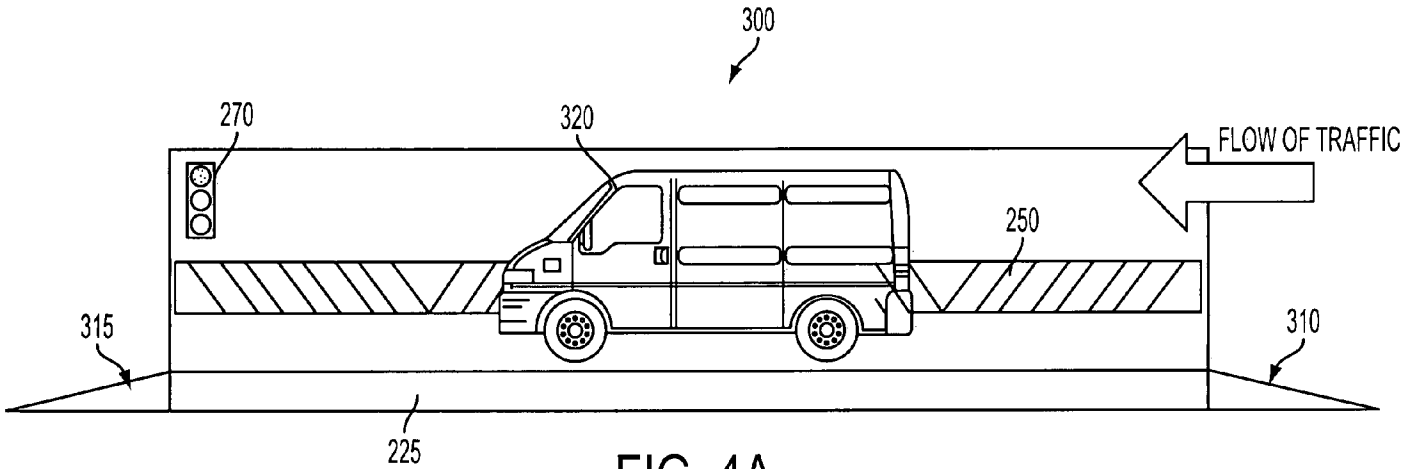
FIGS. 4A and 4B are section views of the channel in single and double-length configurations.
Figure 4B:
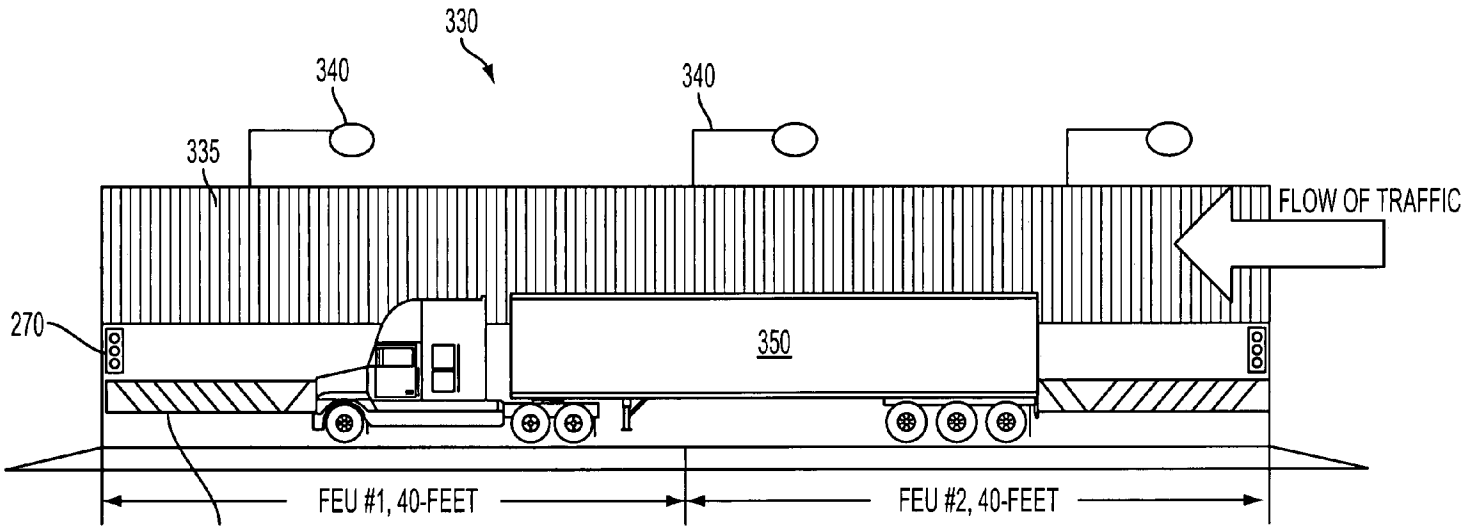

FIGS. 4A and 4B illustrate section (side-elevation) views of the channel 200 as observed from the port side with the port barrier 230 removed for clarity. FIG. 4A shows a single channel 300 having an aft entrance ramp 310 and a front exit ramp 315 disposed between the drive platform 225.

The entrance and exit ramps 310, 315 may be converted from the container doors 125. The bumpers 250 may include slanted stripes or other appropriate markings to denote direction or visually draw attention to them for contact avoidance.

A single vehicle (a minivan) 320, enters the inspection zone 240 and travels along the drive platform 225. The traffic signal 270 indicates to the vehicle's driver when to depart, passing along the drive platform 225 onto the exit ramp 315 and clear the zone 240, thereby enabling the single channel 300 to receive another vehicle and direct traffic in the direction of arrow 325.

FIG. 4B shows dual channels 200 concatenated together as a double FEU-length configuration 330, with the entrance ramp 310 at an aft end and the exit ramp 315 at the forward end of the combination. The double configuration 330 may include elevated extension panels 335 with retractable booms 340 that contain sensors and/or light sources. Such an arrangement may be intended for convoys and/or extended vehicles, such as a semi-tractor-trailer truck 350 as shown. The bumpers 250 and traffic signals 270 may provide ancillary instructions to the truck's driver.

Figure 5:
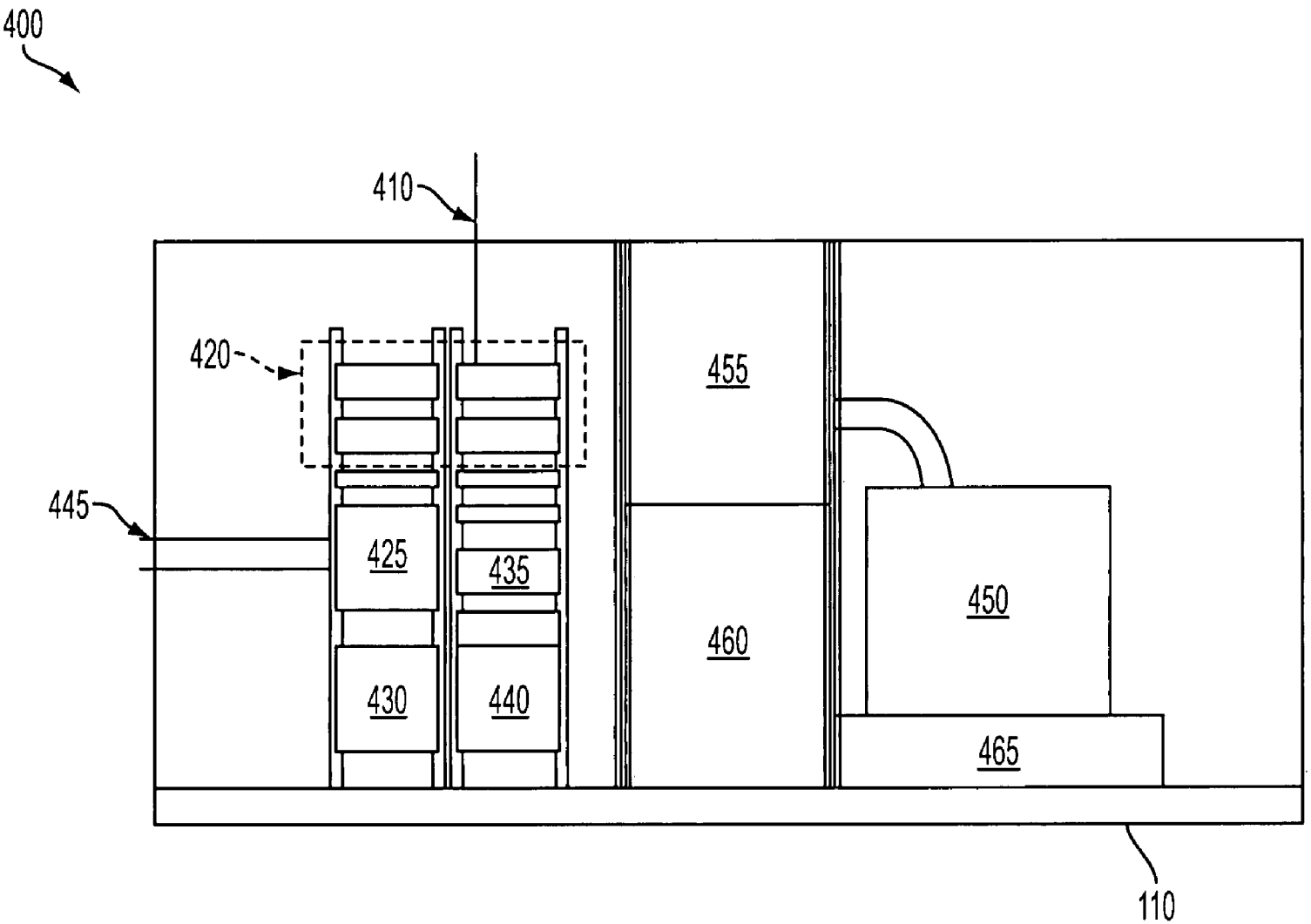
FIG. 5 is an analogous section view of a support bay.

A checkpoint may include, in addition to the instrumented channel 200, a support bay with auxiliary equipment. FIG. 5 shows an elevation view of the support bay 400 having mounts for antennas 410 and racks 415 for various equipment 420. The support bay 400 may be separately portable from the channel 200, such as in a separate freight container (e.g., a TEU equivalent), or stored within the stowed container 100 within the cargo space 195.

The antennas 410 may be designed for radios, satellite communications, cell phones, etc. The equipment 420 for the support bay 400 may be deployed to be installed on the racks 410 disposed alongside the barriers 230, 235. This equipment 420 may include computation, memory and communication components, such as a server 425, a central processing unit (CPU) 430, a redundant array of independent disks (RAID) 435 and a Global Positioning System (GPS) receiver 440. The server 425 may be connected to a local or wide network by fiber optics or twisted pair lines 445.

Electrical power may be independently supplied by a multi-kilowatt diesel power generator 450 and controlled by an automated power management conditioner 455. Fuel (e.g., diesel oil) for the generator may be stored in a 500-gallon storage tank 460 (as shown on the container floor 110).

Additionally, a hazardous material (HAZMAT) storage bin 465 may be used to provisionally collect chemically or radioactively contaminated items until final removal and disposal. The power conditioner 455 and the fuel tank 460 may be externally accessible for maintenance and refueling beyond the inspection zone 240. The equipment 420 may include shock and vibration absorption mechanisms (e.g., spring-mounts on the racks), as well as noise mitigation dampeners.

Figure 6:
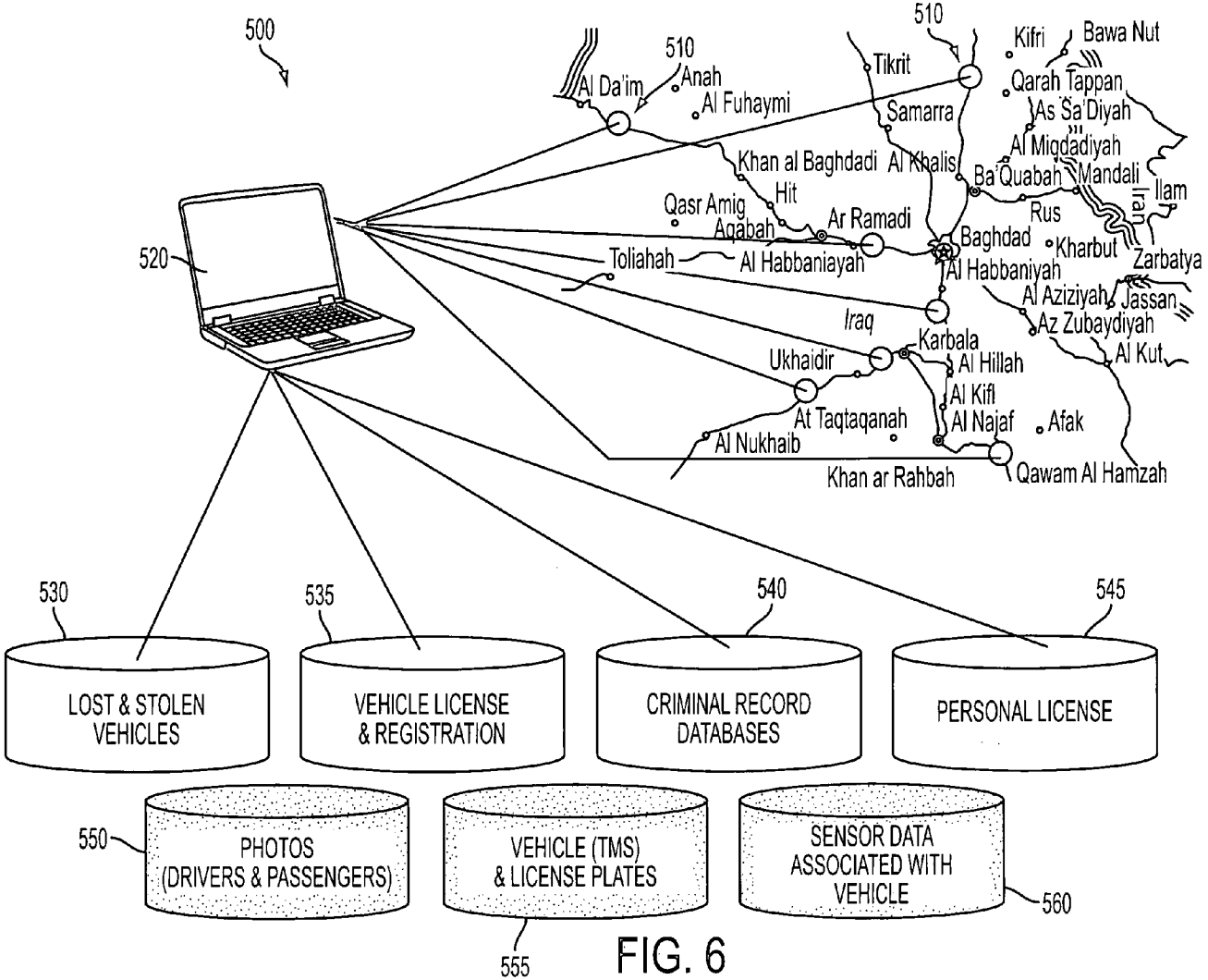
FIG. 6 is a network diagram view of a linked communication and database system.

Each portable checkpoint deployed as the channel 200 may communicate with other checkpoints or with a coordination center having access to one or more databases consulted for investigations. FIG. 6 depicts a network constellation 500 connecting communication nodes 510 to a nexus depicted as a laptop computer 520. Each node may correspond to a checkpoint (whether permanent or relocatable) located within or near a geographical urban site, such as shown for an example region in the Middle-East.

The computer 520 may be in contact with a variety of databases with which to compare information regarding the vehicles 320, 350, or their occupants. Such databases may include vehicle records as lost or stolen vehicles 530, and vehicle registration and licensing 535, personal records for pedestrians or vehicle occupants, such as criminal records 540, and personal identification 545 (e.g., driver's license, passport). The databases may also or alternatively include non-tabular information, such as digitally-recorded facial-recognition photographs 550, vehicle license plates 555 and vehicle sensor data 560.

The CPU 430 may be incorporated as part of or otherwise associated with the computer 520. The server 425 may provide connection to the databases 530, 535, 540, 545, 550, 555, 560. The CPU 430 may perform comparisons between the data received from the sensors 260 and information in these databases. In addition, the CPU 430, in conjunction with the GPS receiver 440, may provide information or instructions to other nodes 510 for coordination of operations to address against an indicated threat.

Figure 7:
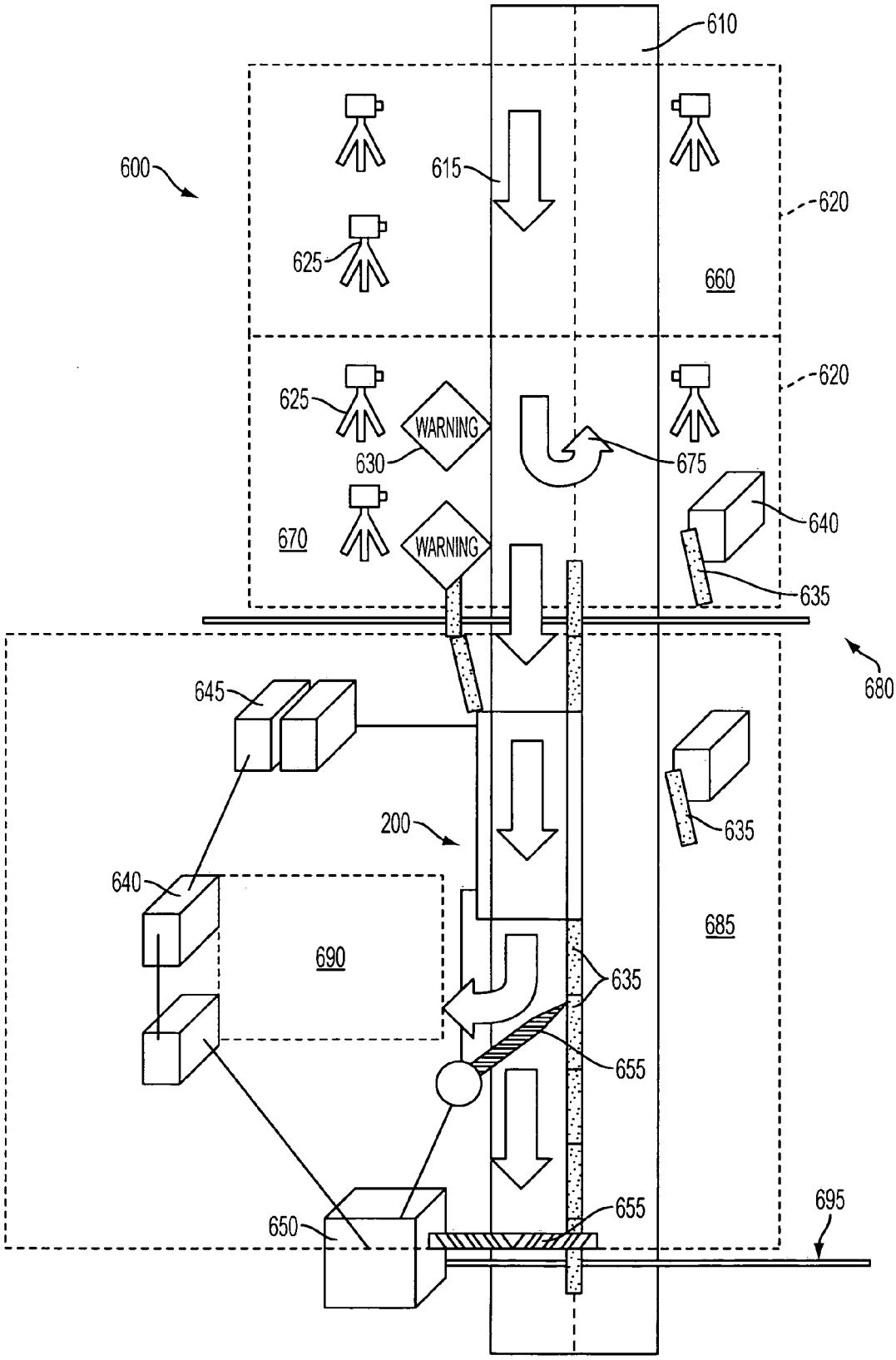
FIG. 7 is a plan view of single-lane checkpoint.

The checkpoint may include several components integrated together to investigate a vehicle traveling along a road. FIG. 7 shows a plan view of a checkpoint 600 for one direction on a two-lane bi-directional road 610, with vehicles to be intercepted traveling in the direction indicated by arrow 615. The checkpoint 600 may include netted sensor grids 620, strategically positioned cameras 625, instruction signs 630, concrete barricades (e.g., obstacles) or jersey walls 635, containment buildings 640, trailers 645, a guard shelter 650 and gates 655. The grids 620 may optionally be stowed in the space 195 of the container 100 while in transport prior to being unfurled. Similarly, the cameras 625 and signs 630 may also be stowed in the space 195.

The grids 620 may engage in surveillance of vehicles traveling in the direction indicated by arrow 615. The instruction signs 630 may provide information to alert drivers to reduced speed and preparation to stop. The jersey walls 635 provide portable obstacles against traffic deviation. The containment buildings 640 may be used for maintaining personnel or detaining custodials. The trailers 645 may be for housing network and power equipment. The guard shelter 650 and gates 655 may be used to control through-traffic.

The checkpoint 600 may be divided into sections. The first section represents a surveillance and monitoring zone 660 having the grid 620 and the cameras 625. The second section represents a commitment zone 670 within which a vehicle may turn around indicated by curved arrow 675. The vehicle reaches a line-of-no-return 680 upon reaching the earliest jersey wall 635, after which the vehicle enters a checkpoint operations zone 685 to approach and enter the channel 200. At this stage, the checkpoint personnel may have options flexible response in depth regarding the approaching vehicle, depending on the level of apparent or perceived risk.

After completion of sensory investigation within the channel 200, the vehicle may be directed by the gates 655 to a detainment (or detention) area 690 for incarceration and/or interrogation of vehicle occupants and possible vehicle impoundment. Otherwise, the vehicle may be permitted to pass through after investigation and proceed past the guard shelter 650 and beyond the line of passage 695.

Figure 8:
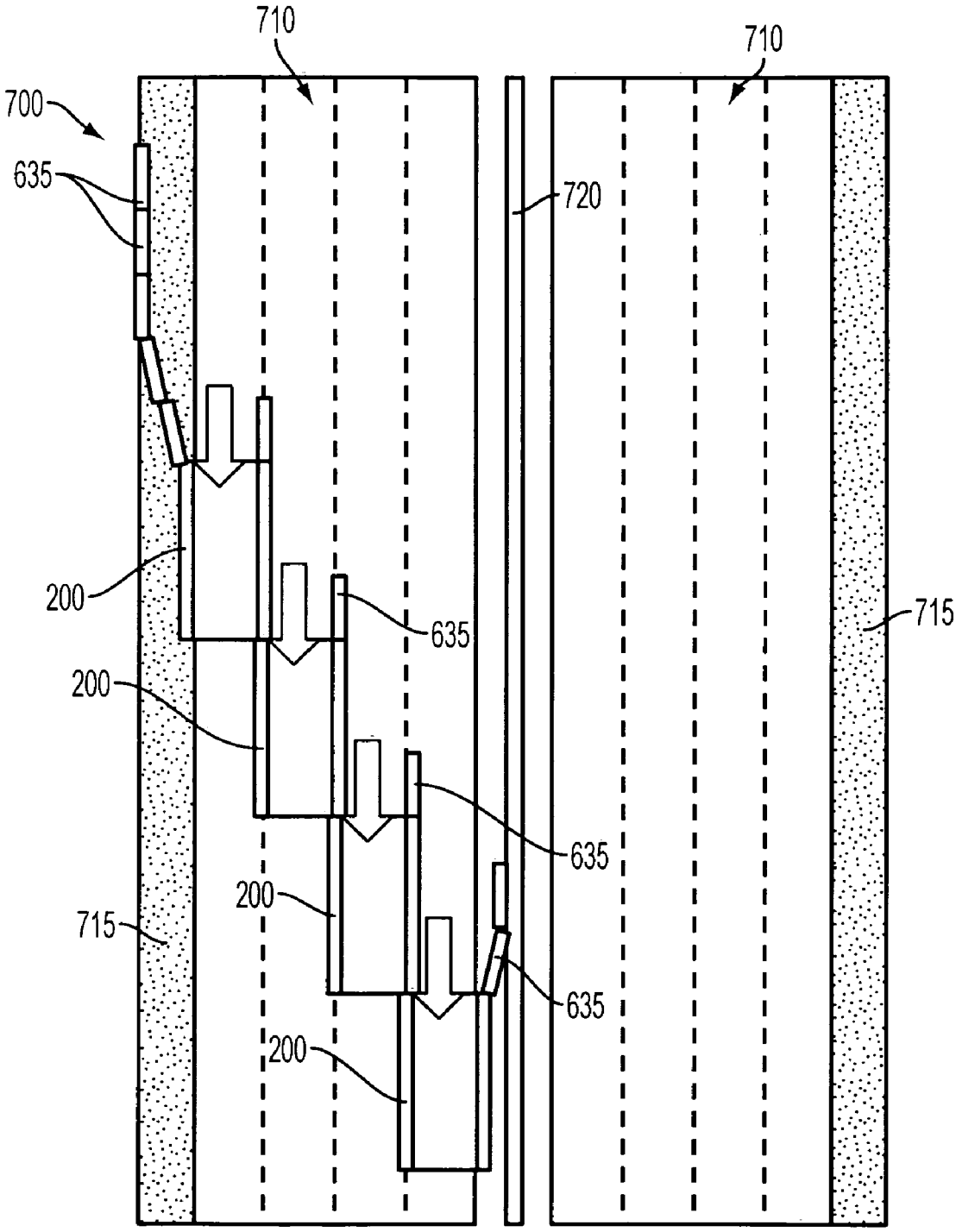
FIG. 8 is a plan view of a multilane checkpoint.

FIG. 8 shows a plan view of a checkpoint 700 for one direction on a single-direction side of an eight-lane divided bi-directional highway 710 with shoulders 715 and a divider 720 separating the two directions. Jersey walls 635 may be disposed along the approach to each of the channels 200 in staggered arrangement, one for each lane.

Under these conditions, a portable checkpoint can be established by transporting one or more freight containers 100 to an intended destination site, such as along an otherwise non-blockaded road 610. Upon delivery to the temporary checkpoint destination, the container 100 may be deployed to form an instrumented channel 200. Auxiliary equipment and barriers may be tactically disposed at the site to direct traffic as individual vehicles 320 into the channel 200 for preliminary inspection.

Depending on verification of innocuous nature or else indication of threat possibility, the vehicle 320 may be authorized to proceed or be further detained for more thorough investigation. Upon completion of the mission objectives, the equipment may be recovered and the channel 200 be folded into the stowed container 100 again.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A configurable freight container disposable into closed and open configurations, the open configuration enabling a vehicle to drive therethrough, the container comprising:

a quadrilateral set of walls connectable to form a rectangular box;

a hinge that joins two adjacent walls along a pivotable edge, the hinge being pivotable between perpendicular and coplanar positions corresponding respectively to the closed and open configurations; and a joint that reversibly connects two walls opposite the adjacent walls along a separable edge, the joint being disconnectable between lock and unlock positions corresponding respectively to the closed and open configurations, wherein the perpendicular position disposes the two adjacent walls to be mutually perpendicular at the pivotable edge forming the rectangular box, and the coplanar position disposes the two adjacent walls to form substantially mutually coplanar platforms on which the vehicle can drive, and the lock position disposes the two opposite walls to be mutually perpendicular at the separable edge, and the unlock position disposes the opposite walls to form substantially mutually parallel barriers that define an inspection zone.

2. The container according to claim 1, further comprising:

a set of doors that close the rectangular box by latching to an opposing pair of walls, the opposing pair being mutually parallel in the closed configuration.

3. The container according to claim 2, wherein the doors are convertible to ramps from a ground level to a level of the coplanar platforms.

4. The container according to claim 1, further comprising:

a cable extending across the opposite walls while disconnecting the joint.

5. The container according to claim 1, wherein the hinge includes a hydraulic actuator to rotate one wall of the adjacent walls to be substantially coplanar with the other wall of the adjacent walls.

6. The container according to claim 1, further comprising:

a bumper along at least one of the barriers on an inside surface;

an instrument on at least one of the barriers and the platforms for measuring a characteristic of the vehicle;

a light source on at least one of the barriers for illuminating the inspection zone; and a traffic signal on at least one of the barriers to provide instructions for operating the vehicle in the zone.

7. The container according to claim 1, further comprising within one of the barriers:

a set of equipment for communication, computation and data storage;

a generator to provide electrical power;

a fuel supply to provide fuel to the generator; and a power conditioner to regulate the electrical power from the generator.

8. The container according to claim 7, wherein the conditioner and fuel supply are accessible from outside the barrier.

9. The container according to claim 1, wherein at least one of the platforms has an adjustable pad on an exterior surface to adjust a ground distance of the platform such that the platforms are substantially mutually coplanar.

10. A portable configurable checkpoint to intercept and inspect an approaching vehicle, comprising:

an obstacle to direct the vehicle in traffic flow; and a configurable freight container that includes:

a quadrilateral set of walls connectable to form a rectangular box;

a hinge that joins two adjacent walls along a pivotable edge, the hinge being pivotable between perpendicular and coplanar positions corresponding respectively to the closed and open configurations; and a joint that reversibly connects two walls opposite the adjacent walls along a separable edge, the joint being disconnectable between lock and unlock positions corresponding respectively to the closed and open configurations, wherein the perpendicular position disposes the two adjacent walls to be mutually perpendicular at the pivotable edge forming the rectangular box, and the coplanar position disposes the two adjacent walls to form substantially mutually coplanar platforms on which the vehicle can drive, and the lock position disposes the two opposite walls to be mutually perpendicular at the separable edge, and the unlock position disposes the opposite walls to form substantially mutually parallel barriers that define an inspection subzone, wherein the obstacle directs the vehicle towards the open container.

11. The checkpoint according to claim 10, further comprising:

a deployable sensor grid to detect presence of the vehicle within a checkpoint zone; and a positionable camera to record an image of the vehicle.

12. The checkpoint according to claim 10, further comprising:

a building to maintain equipment and personnel for responding to the vehicle within a checkpoint zone;

a trailer to house equipment for the open container; and a gate to direct the vehicle after passing through the inspection subzone to one of a detention area and beyond the checkpoint zone.

13. The checkpoint according to claim 10, further comprising:

a communications system accessible to a database, wherein the database includes information, on at least one of vehicle identification, vehicle sensory characteristics, personal identification and facial-recognition photographs for comparison with the vehicle and the occupants therein.

14. The checkpoint according to claim 13, wherein the communication system is accessible to another checkpoint at a separate location.

* * * * *